United States Patent [19]

Bardes

[11] 4,420,086

[45] Dec. 13, 1983

[54] FILING HANGER

[75] Inventor: Peter G. Bardes, Milwaukee, Wis.

[73] Assignee: Bardes Products, Inc., Milwaukee, Wis.

[21] Appl. No.: 217,173

[22] Filed: Dec. 16, 1980

[51] Int. Cl.[3] ..... A47B 63/00

[52] U.S. Cl. ..... 211/46; 312/184

[58] Field of Search ..... 211/46; 312/184, 183, 312/186

[56] References Cited

U.S. PATENT DOCUMENTS

| | | | |
|---|---|---|---|
| 1,217,243 | 2/1917 | Tucker et al. | 312/184 |
| 2,253,788 | 8/1941 | Kern | 211/46 X |
| 2,851,167 | 9/1958 | Rosenberg | 211/46 |
| 3,730,738 | 5/1973 | Cook et al. | 312/184 X |
| 4,181,381 | 1/1980 | Amand | 312/184 X |

FOREIGN PATENT DOCUMENTS

| | | | |
|---|---|---|---|
| 2376758 | 4/1978 | France | 312/184 |
| 70137 | 6/1952 | Netherlands | 312/184 |

*Primary Examiner*—Ramon S. Britts
*Assistant Examiner*—Peter A. Aschenbrenner
*Attorney, Agent, or Firm*—Andrus, Sceales, Starke & Sawall

[57] ABSTRACT

A filing hanger comprising a first strap extending across the upper edge of the sheet to be filed. The strap extends along one side of the sheet. A second strap extends across the upper edge of the sheet along the other side. At least one of the first and second straps has a hook at each end for engaging one of the bars in the file drawer. A projection on one of the straps extends through the perforations in the sheet and into a hole on the other strap for fastening the straps to each other and to the sheet. The straps are preferably hinged together at spaced points along the straps.

8 Claims, 5 Drawing Figures

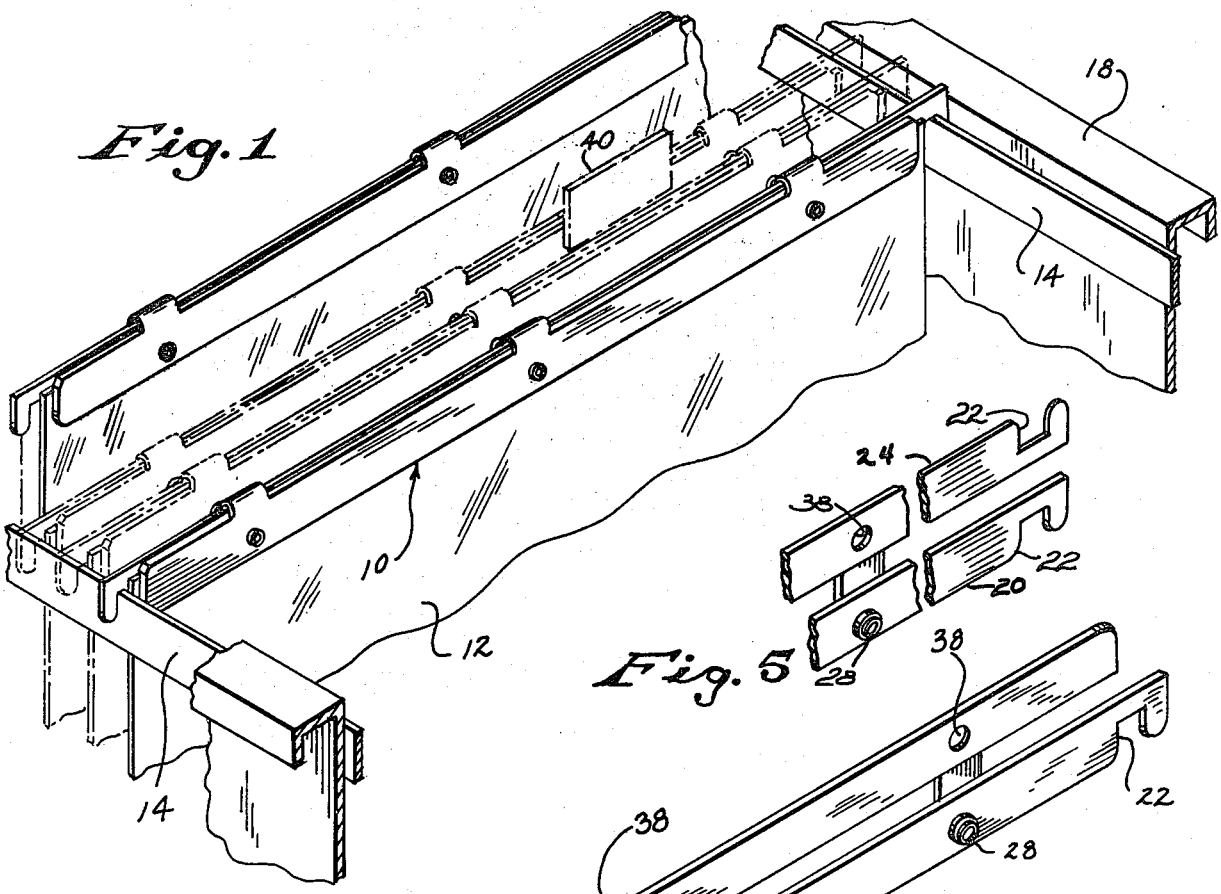
Fig. 1
Fig. 5
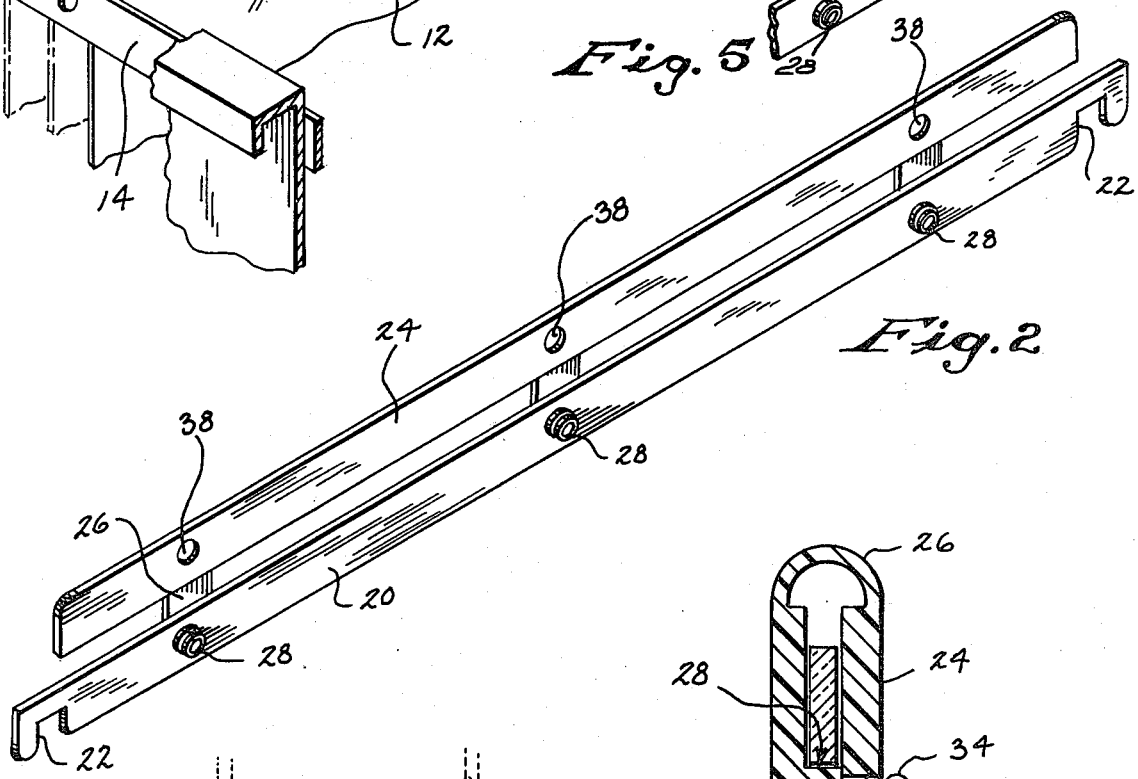
Fig. 2
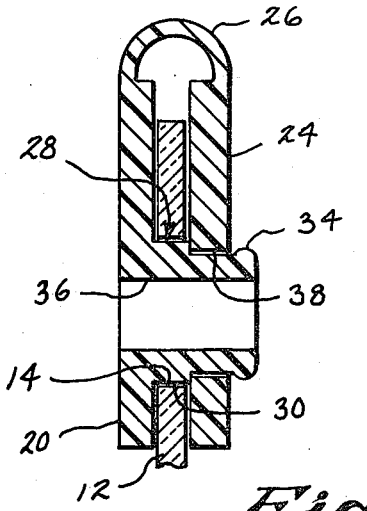
Fig. 4
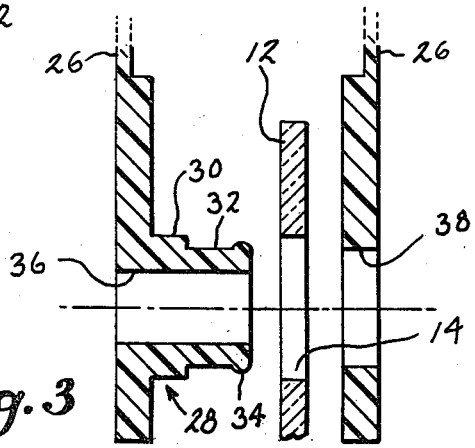
Fig. 3

FILING HANGER

The present invention relates to an improved device for storing or filing generally sheet-like materials.

A common system for filing materials is the so-called "hanging file" system. In such a system, the file folders are equipped with hooks that permit them to be hung or suspended on rods along either side of the file drawer or cabinet. The sheet materials to be filed are placed in the file folders. The system permits easy access to the files while insuring that the filing folders do not drop down and become lost or overlooked.

The present invention is directed to an economical and convenient means for hanging perforated sheet materials, such as that used in three-ring binders, in a hanging file drawer or cabinet. The device eliminates the need for the file folders heretofore utilized. Among the materials that may be filed with the present invention are transparent envelopes suitable for storing transparencies or photographs.

Briefly, the present invention provides a filing hanger comprising a first strap extending across the upper edge of the sheet to be filed. The strap extends along one side of the sheet. A second strap extends across the upper edge of the sheet along the other side. At least one of the first and second straps has a hook at each end for engaging one of the bars in the file drawer. A projection on one of the straps extends through the perforations in the sheet and into a hole on the other strap for fastening the straps to each other and to the sheet. The straps are preferably hinged together at spaced points along the straps.

In the drawing:

FIG. 1 is a perspective view showing the filing hanger of the present invention with a perforated sheet and the associated portions of the filing cabinet.

FIG. 2 is a perspective view of the filing hanger of the present invention.

FIG. 3 is a cross-sectional view through the filing hanger and associated sheet of material with the straps in the unfastened condition.

FIG. 4 is a cross-sectional view, similar to FIG. 3, showing the straps in the fastened condition.

FIG. 5 is a fragmentary perspective view of a modification of the present invention.

Turing now to the figures, the filing hanger of the present invention is indicated by the numeral 10. Hanger 10 is suitable for use with sheet 12 having perforations 14 along one edge. See FIG. 3. Such a sheet may resemble or correspond to a sheet typically used in a three-ring binder. The sheet may be a single sheet or may be a multiple layer sheet structure, such as the clear plastic envelopes commonly used to hold transparencies in pockets or to hold photographs.

Filing hanger 10 is suitable for supporting sheet 12 in a vertical hanging position between a pair of spaced, horizontal bars, 16, such as are typically found in a file drawer or cabinet, a portion of which is shown as 18 in FIG. 1.

Filing hanger 10 includes a first strap 20. Strap 20 has a hook 22 at either end that fits over bars 16 to support the strap on the bars. A second strap 24 is positioned parallel to strap 20. Strap 24 is joined to strap 20 by hinges 26. In a preferred embodiment of the invention, straps 20 and 24 are formed of injection moulded plastic material. Hinges 26 may be integrally formed with straps 20 and 24 as thinner links extending between the straps at spaced intervals along them. See FIG. 4.

Strap 20 contains a plurality of projections 28 positioned to correspond to holes 14 in sheet 12. As shown most clearly in FIG. 3, each projection 28 includes a cylindrical base 30 terminating in an end 32 of reduced diameter. The projection ends in annular ridge 34. If desired, hole 36 may extend through projection 28 to facilitate the moulding process.

As shown in FIGS. 2 and 3, strap 24 contains holes 38 that fit over projection 28. Holes 38 are sized so that strap 24 fits over ridge 34 with a slight interference to surround end 32 and rest on base 30. This holds the straps together while providing a small spacing between straps 20 and 24 sufficient to accommodate the sheets of material 12 while minimizing the thickness of the hanger so as to maximize the holding capacity of the filing cabinet or drawer.

In use, sheet 12 is placed on strap 20 so that the projections 28 lie in holes 14 to position the sheet on the strap. Hinges 26 are then bent to position strap 24 beside strap 20, as shown in FIG. 3. Straps 20 and 24 are pressed together to insert end 32 in hole 38 to retain the straps together with sheet 12 between them, as shown in FIG. 4. Hooks 22 may then be placed on bars 16 to hang sheet 12 in a vertical position.

If desired, filing hangers 10 may be color coded to assist in storage or retrieval of a plurality of sheets 12. Appropriate index tabs 40 may also be placed on hangers 10, as shown in FIG. 1, on the portions of the straps between hinges 26.

As shown in FIG. 5 both straps 20 and 24 may be provided with hooks 22, if desired.

Various modes of carrying out the invention are contemplated as being within the scope of the following claims particularly pointing out and distinctly claiming the subject matter which is regarded as the invention.

I claim:

1. A filing hanger for supporting the upper edge of a vertically hanging sheet of material on a pair of spaced horizontal bars, said sheet having a plurality of perforations along the upper edge, said hanger comprising:

a first strap extending across the upper edge of the sheet along one side thereof;

a second strap extending across the upper edge of the sheet along the other side thereof, at least one of said first and second straps having a hook means at each end suitable for engaging one of the spaced bars; and means mounted on one of the straps extending through the perforations in the sheet for coaction with means on the other of said straps for removably fastening said straps to each other and to the sheet, said fastening means including projections on one of said straps lockingly engaging holes on the other of said straps, each said projection including a circular base having an end section of reduced diameter terminating in an annular ridge, and wherein each said hole in said other strap is sized to lockingly engage said end section and ridge of a projection.

2. The filing hanger according to claim 1 wherein both of said straps have hook means at each end suitable for engaging one of the space bars.

3. The filing hanger according to claim 1 wherein said straps are formed as thin, elongated elements.

4. The filing hanger according to claim 1 wherein said first and second straps are hinged together.

5. The filing hanger according to claim 4 wherein said straps are hinged together by a plurality of flexible links at spaced points along the straps.

6. The filing hanger according to claim 5 wherein said straps are formed of a plastic material, and said links are integrally formed with said straps.

7. The filing hanger according to claim 6 including an index tab mounted on a strap intermediate said flexible links.

8. The filing hanger according to claim 6 wherein said links have a thinner cross section than said straps to provide flexibility to said links.

* * * * *